US005249715A

United States Patent [19]

Tobler

[11] Patent Number: 5,249,715

[45] Date of Patent: Oct. 5, 1993

[54] DISPENSING CONTAINER WITH AN OPTIONALLY REMOVABLE INSERT IN THE NECK OF THE CONTAINER

[75] Inventor: Viktor Tobler, Oberdurnten, Switzerland

[73] Assignee: Supermatic Kunststoff AG, Uster, Switzerland

[21] Appl. No.: 960,697

[22] Filed: Oct. 14, 1992

[51] Int. Cl.[5] ..... B05B 11/04; B65D 47/28; B67D 5/00

[52] U.S. Cl. ..... 222/519; 222/211; 222/212; 222/522

[58] Field of Search ..... 222/190, 211, 212, 519-522, 222/566-570, 562

[56] References Cited

U.S. PATENT DOCUMENTS

| | | | |
|---|---|---|---|
| 2,980,342 | 4/1961 | Armour | 222/211 |
| 3,152,734 | 10/1964 | Berry | 222/211 |
| 3,168,969 | 2/1965 | Krieps | 222/520 |
| 3,366,284 | 1/1968 | Marona et al. | 222/211 |
| 3,622,049 | 11/1971 | Thompson | 222/211 X |
| 3,834,596 | 9/1974 | Brady et al. | 222/520 |
| 4,157,789 | 6/1979 | Laauwe | 222/211 X |
| 4,358,031 | 11/1982 | Lohrman . | |
| 4,509,661 | 4/1985 | Sugizaki et al. | 222/211 X |
| 4,708,260 | 11/1987 | Siegal et al. | 222/562 X |
| 5,048,750 | 9/1991 | Tobler | 222/211 X |
| 5,064,103 | 11/1991 | Bennett | 222/211 X |

FOREIGN PATENT DOCUMENTS

| | | |
|---|---|---|
| 1607914 | 3/1972 | Fed. Rep. of Germany . |
| 1370761 | 7/1964 | France . |

*Primary Examiner*—Kevin P. Shaver

*Attorney, Agent, or Firm*—Oblon, Spivak, McClelland, Maier & Neustadt

[57] ABSTRACT

The dispensing device serves for discharging a free-flowing medium from a container. An insert arranged in the container neck and filling the clear cross-section of the latter has a design suitable for discharging the free-flowing medium. The insert resting on the container neck is held firm by a catch having a bead on the container neck and a groove on the insert. In the case of a container intended for refilling, this catch can be overcome and the insert can be pulled out from the container neck by a cam projecting radially on the inside of the screw cap and engaging behind the end flange. If reuse of the container is to be ruled out, the cam on the cap is absent. In the case of a modified embodiment, the bead extending into the groove and the groove itself are dimensioned to be of different sizes in the radial direction. If the bead is dimensioned to be larger, the catch cannot be overcome.

8 Claims, 2 Drawing Sheets

DISPENSING CONTAINER WITH AN OPTIONALLY REMOVABLE INSERT IN THE NECK OF THE CONTAINER

BACKGROUND OF THE INVENTION

1. Field of the Invention

The invention relates to a dispensing device for free-flowing preparations having a container for receiving a free-flowing medium for the purpose of being discharged from the container, for example, by spraying or foaming by means of air pressure.

2. Discussion of the Background

Known devices of a dispensing type have a container for receiving a free-flowing content which, by various ways, for example, by spraying, atomizing or by generating foam, may be discharged. For this purpose, the container has an insert fitted into the container neck and a cap screwed onto the container neck, it being possible for the container insert and the cap to accommodate means especially designed for one of these types of discharge, such as mixing-chamber and distributor elements and a delivery path up to an outlet opening. For discharging the content, however, a pump which can be operated manually or by a motor may also be provided.

In the case where containers are used of this type having a cap which can be screwed onto the container neck, it is known to provide on the inside of the cap a so-called refill cam, which interacts with a portion of the container neck and, for limiting cap screwing movement, has the function either of preventing any further screwing-on of the cap beyond the open position, so that the container cannot be filled up again, or of allowing refilling if the system comprising a cam and stop on the container is especially designed for running over the stop position. The risk of overturning or tearing off parts of this stop is, however, relatively great and, if this occurs, the actual purpose of this measure (i.e. making refilling of the container impossible) can no longer be achieved. This may be required for various reasons, for example because the remainder of the container's contents cannot be removed and are not compatible with any other product. A stop positioned on the screw cap which sacrifices its effectiveness can no longer prevent complete opening of the container and removal of the parts arranged in the container neck, with the result being that the intended prevention of refilling is lost.

SUMMARY OF THE INVENTION

The invention is therefore based on the object of providing a device in which the parts interacting with a refill cam are arranged at a more suitable point and are designed in such a manner that they are not subject to any risk of sacrificing their effectiveness by incorrect manipulation, for example by excessive use of force. At the same time, this is possible with little expenditure in terms of production technology. Preferred embodiments of the invention have the features of the dependent claims.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
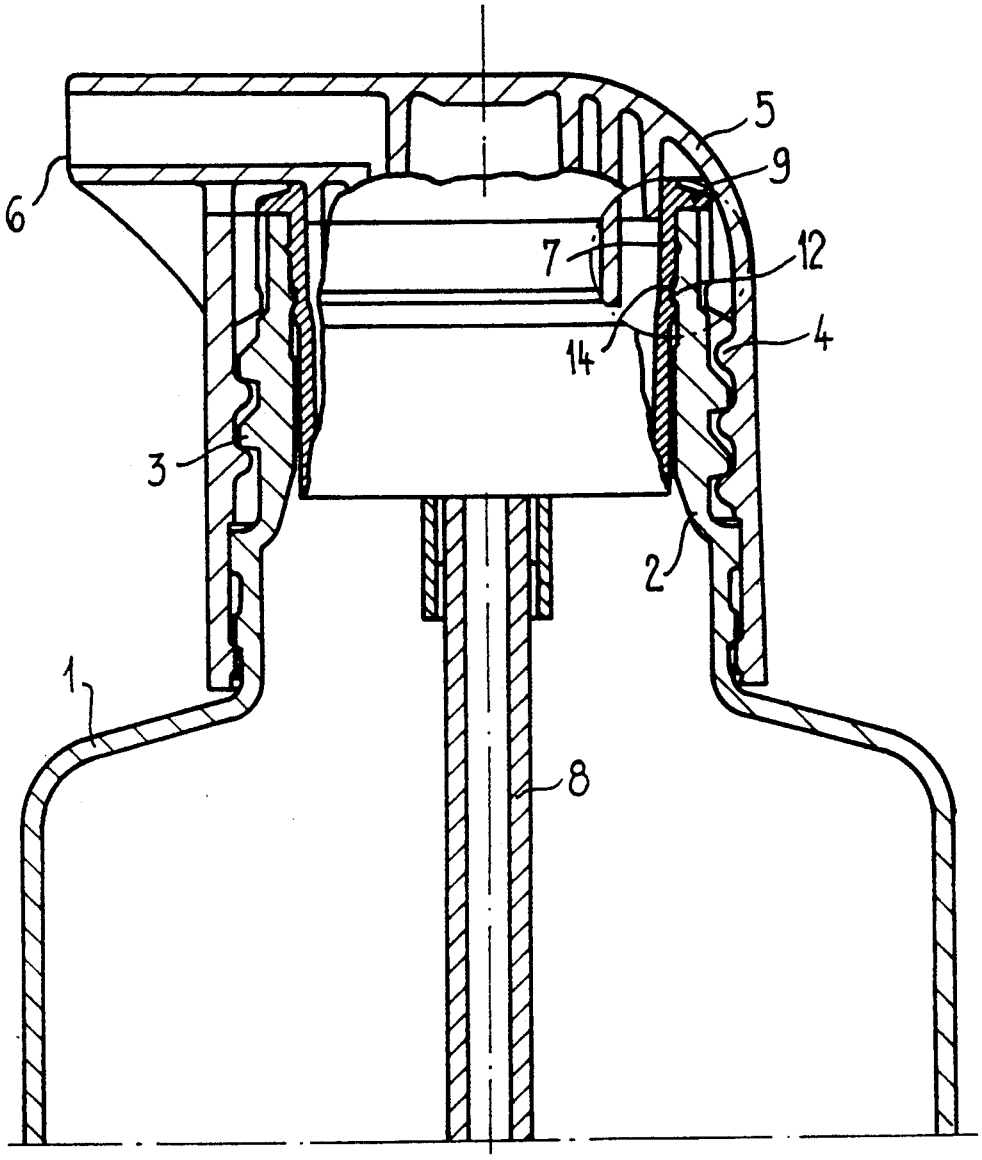
FIG. 1 shows a vertical sectional view taken through the upper part of a container for generating and dispensing foam, with the screw cap in the closed position.

The container 1 with an opening represented in FIG. 1 shows only its upper part and has a container neck 2, which is provided with an external thread 3 and which has positioned thereon a cap 5 which is provided with an internal thread 4 so as to be screwed onto the external thread 3. In the case of a so-called push-pull closure, the cap has no thread. The cap 5 is movable between a closed position, according to FIG. 1, and an open position, shown in FIG. 2, by a screwing movement in the axial direction of the container neck. The cap 5 has, furthermore, an outlet opening 6, from which in the present example foam emerges when the container 1, consisting of pliable plastic material, is squeezed manually as shown by the arrows in FIG. 2, so that the air present above the foamable liquid contained in the container 1 combines with the liquid under the effect of the pressure thereby created to produce foam. This takes place in an insert 7 which is arranged in the container neck 2 and is designed in a special manner, in order to produce foam, which is not of significance, however, in conjunction with the present invention because the subject-matter of the invention also relates to a container having a differently designed insert 7, which is suitable for atomizing or spraying a liquid. In the case of a nonsqueezable container, the pressure for discharging the contents can be generated by a manually operable pump. The invention relates to any type of container in the container neck 2 of which an insert 7 is positioned. In the case of liquid contents in the container, this insert is connected to a riser or tube 8 for the liquid, extending into the interior of the container. In the case of pasty contents in the container, the riser is omitted. The interior of the insert accommodates delivery paths of various designs for different types of discharging, e.g. by spraying or foaming. What is important is that the insert is of the same design on the outer circumference in each embodiment.

Figure 2:
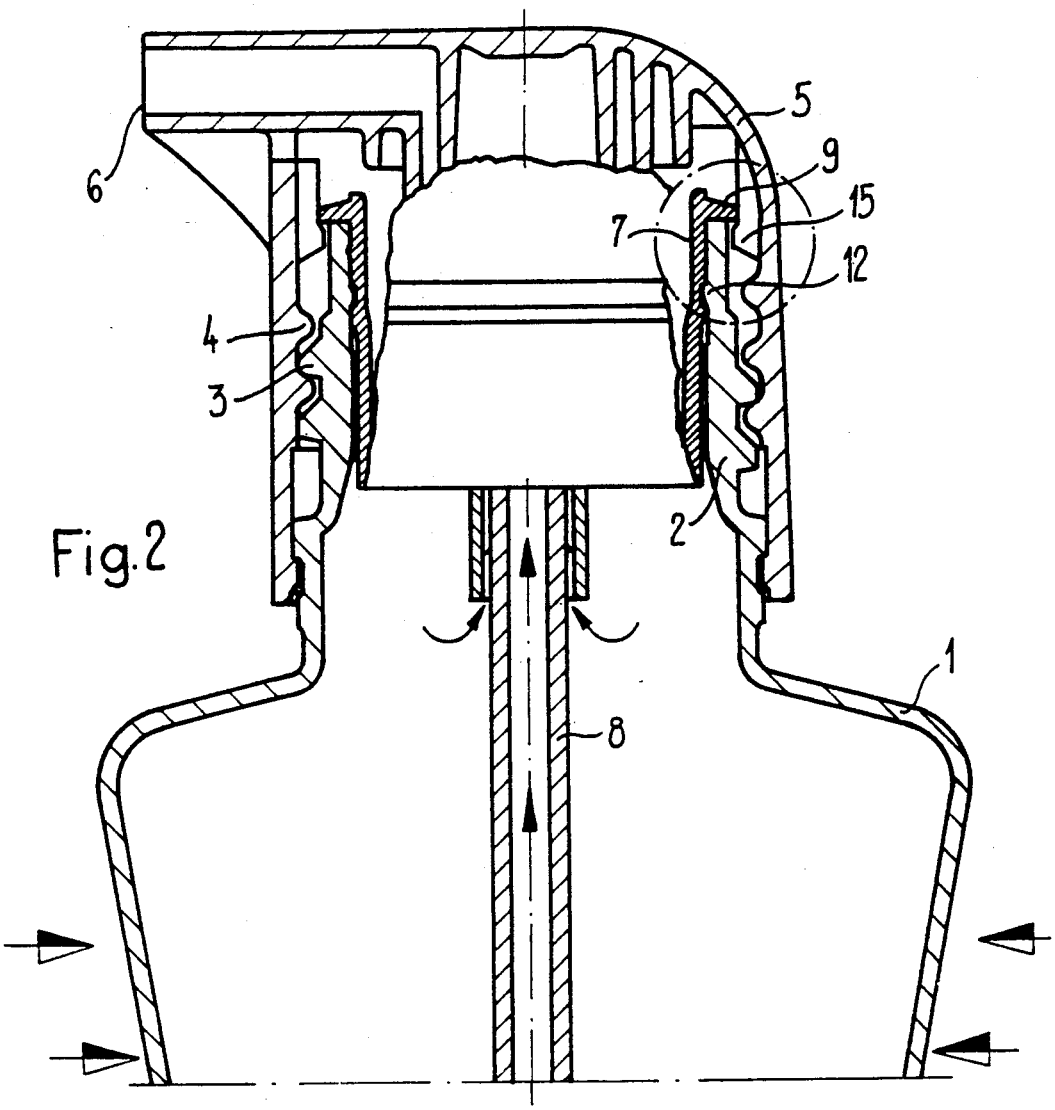
FIG. 2 shows a vertical sectional view taken through the container according to FIG. 1, with the screw cap being in an open position.
Figure 3:
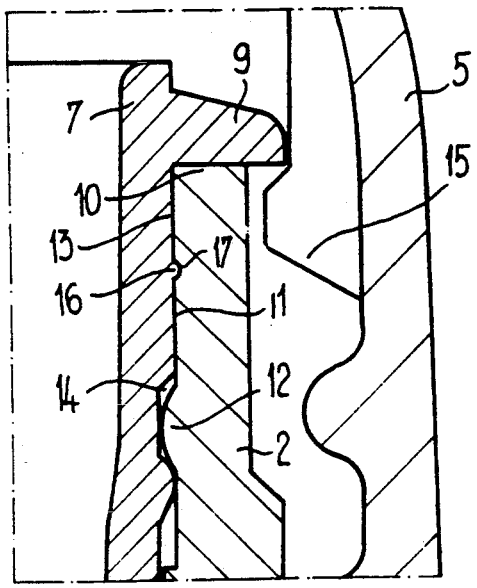
FIG. 3 shows the cutout indicated by the circle in FIG. 2 but on an enlarged scale.

The region encircled in FIG. 2 is represented in FIG. 3 on an enlarged scale. The externally essentially cylindrical insert 7 is fitted into the container neck 2 and has at the upper end thereof a end flange 9 which protrudes radially outward beyond the radial diversion of container neck 2 and by which the insert 7 rests on the end face 10 of the container neck 2. Inward from this container neck end 10, the otherwise cylindrical container neck inner side 11 has a radially inwardly projecting bead 12 and the outer side 13 of the insert 7 has a groove 14 interacting with the bead 12, in which groove the bead 12 engages, so that this groove-bead connection 12, 14 forms a catch against pulling out the insert 7 in the axial direction.

For pulling out the insert 7 in the case of a container intended for refilling, there is arranged on the inside of the screwable cap a cam 15, which is designed so as to project radially inward in the direction of the container neck 2. This so-called refill cam 15 engages behind the projecting end flange 9 of the insert 7, so that, during the screwing movement of the cap 5 in the opening direction, the insert 7 is moved along in the axial direction, the catch formed by the bead 12 and the groove 14 being overcome because the plastic material used for all the parts can resiliently yield.

If the container is not to be refillable again, there is no cam 15 on the cap 5, so that the insert 7 cannot be pulled out from the container neck 2.

In the case of a modified second embodiment, the groove-bead connection 12, 14 in the case of a container intended for reuse has a height dimension, measured in the radial direction, of the bead 12 for engaging the groove 14 which is less than the corresponding radial height dimension of the groove-bead connection 12, 14 in the case of a container not suitable for reuse.

This catch formed by connection 12, 14 therefore acts only in a limited manner and, depending on the chosen dimensioning of the bead 12, can be overcome if the insert 7 is intended for a container 1 which is to be refillable, for which purpose the insert 7 has to be removed from the container neck. The catch cannot be overcome, however, if a bead 12 of greater radial dimension is provided in the case where the container is not to be refillable. The difference in the dimensioning of the bead 12 is not very great, for example the bead 12 in the case of a refillable container projects 0.2 mm inward beyond the cylindrical container inner side 11 and in the case of a non-refillable container projects 0.4 mm beyond this inner side. In other words, the bead 12 has a selectably different sized diameter for two different types of containers 1, one of which is refillable and the other of which is non-refillable.

The catch formed by the groove-bead connection 12, 14 can be overcome only in the case of the smaller-dimensioned bead 12. The cam 15 on the cap 5 is, furthermore, designed in such a way that it tears off if there is a larger dimensioned bead 12, so that the catch formed by the bead 12 and the groove 14 cannot be overcome and the insert 7 consequently remains in the container neck 2. Consequently, the container cannot be refilled and, as intended by the manufacturer, is no longer usable.

A small annular bead 16, which is formed between the end flange 9 and the groove 14 on the insert 7 and presses into the container neck 2, serves for achieving a tight contact between the insert 7 and container neck 2, because the liquid contained in the container can get in between the latter.

As a departure from the design represented, the bead 12 may also be formed on the insert 7 and the groove 14 conversely may be formed on the container neck 2. Every possible embodiment of such catch ensures that a container of the type described herein is no longer usable if this is necessary for one of the reasons mentioned hereinabove.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A dispensing device for free-flowing preparations, which comprises:

a container for receiving a free-flowing medium for the purpose of being discharged from the container, the container having an opening and a neck with a cylindrical inner wall;

a cylindrical insert fitted into the container neck;

a closure member for engaging an outer portion of the container neck and at least partially closing said opening of said container;

interengaging groove-and-bead connection members formed in the cylindrical insert and the cylindrical wall of the container neck for forming a catch for limiting axial mobility of said insert and said container neck relative to each other wherein, for allowing said container to be reused, the closure member engages an outside portion of the container neck and a cam is located on an inside portion of the closure member, said cam projecting radially inwardly toward the container neck and wherein, upon axial movement of the closure member in an opening direction, said cam bears against a rim portion of an end portion of said insert which projects radially outward beyond the radial dimension of the container neck and which, upon further axial movement of the closure member in the opening direction, permits the insert to be pulled out from the container neck due to overcoming the ability of the catch to limit said axial mobility of said insert and said container neck relative to each other.

2. A dispensing device for free-flowing preparations, which comprises:

a container for receiving a free-flowing medium for the purpose of being discharged from the container, the container having an opening and a neck with a cylindrical inner wall;

an insert fitted into the container neck;

a closure member for engaging an outer portion of the container neck and at least partially closing said opening of said container;

interengaging grove-and-bead connection members formed on said insert and said container neck so as to form a catch for limiting axial movement of said insert and said container neck relative to each other; wherein when the container is intended for reuse, the closure member is formed on an inner side thereof with a cam and the groove-and-bead connection members have one of a first and second radial dimension, the second radial dimension being greater than the first radial dimension and wherein the cam is made of a material which can be torn and is dimensioned such that during axial movement of the closure member in the opening direction, the cam engages a portion of the insert so as to pull out the insert from the container neck when the connection members have the first radial dimension and the cam is destroyed by being torn by a portion of the insert when the connection members have the second radial dimension.

3. A device according to claim 2, wherein the cam is dimensioned so as to be destroyed if the insert is intended to remain in the container neck upon removal of said closure member.

4. A device according to claims 1 or 2, wherein the bead of the groove-and-bead connection members is formed on an inner side of the container neck and the groove of the groove-and-bead connection members is formed on an outer side of the insert.

5. A device according to claim 2, wherein the radial dimension of the bead and the radial depth of the groove are each substantially 0.2 mm when the insert is to be pulled out by means of said cam and is substantially twice as large in the case where the insert cannot be pulled out.

6. A device according to claims 1 or 2, wherein the rim of the insert includes an end flange projecting radially outwardly beyond the radial dimension of the remainder of the insert and wherein between the end flange and the groove-and-bead connection members there is formed a further annular bead on the insert which pressingly engages the container neck.

7. The dispensing device as set forth in claim 1, wherein said closure member comprises a cap having threads and wherein said cam is mounted on said cap and spaced from said threads.

8. A dispensing device as claimed in claim 1, wherein said bead of said groove-and-bead connection members projects inward substantially 0.2 mm.

* * * * *